US008991298B2

(12) United States Patent
Bruin et al.

(10) Patent No.: US 8,991,298 B2
(45) Date of Patent: Mar. 31, 2015

(54) APPARATUS FOR DRAINAGE BY WELL POINTS

(71) Applicant: B.B.A. Participaties B.V., Klarenbeek (NL)

(72) Inventors: Johannes Bruin, Klarenbeek (NL); Harmen Bruin, Apeldoorn (NL)

(73) Assignee: B.B.A. Participaties B.V., Klarenbeek (NL)

( * ) Notice: Subject to any disclaimer, the term of this patent is extended or adjusted under 35 U.S.C. 154(b) by 0 days.

(21) Appl. No.: 14/451,053

(22) Filed: Aug. 4, 2014

(65) Prior Publication Data

US 2014/0377092 A1 Dec. 25, 2014

Related U.S. Application Data

(63) Continuation of application No. PCT/NL2013/050386, filed on May 28, 2013.

(30) Foreign Application Priority Data

Jun. 6, 2012 (NL) ..... 2008949

(51) Int. Cl.

| | |
|---|---|
| ***F01B 9/02*** | (2006.01) |
| ***F01B 31/10*** | (2006.01) |
| ***E02D 19/10*** | (2006.01) |
| ***F04B 35/01*** | (2006.01) |

(52) U.S. Cl.

CPC ..... *E02D 19/10* (2013.01); *F04B 35/01* (2013.01)

USPC ..... 92/140; 92/139; 92/147; 92/157

(58) Field of Classification Search

USPC ..... 92/139, 140, 146, 147, 157

See application file for complete search history.

(56) References Cited

U.S. PATENT DOCUMENTS

| | | | | |
|---|---|---|---|---|
| 779,907 | A * | 1/1905 | Cheshire | 417/419 |
| 1,556,832 | A * | 10/1925 | Holmgreen | 74/108 |
| 1,628,096 | A * | 5/1927 | Worth | 92/140 |
| 2,137,552 | A * | 11/1938 | Valentine | 92/73 |
| 3,496,875 | A * | 2/1970 | Van Allen et al. | 92/140 |
| 6,439,104 | B1 * | 8/2002 | Tonogai et al. | 92/140 |
| 8,376,723 | B2 * | 2/2013 | Kugelev et al. | 92/140 |
| 8,454,328 | B2 * | 6/2013 | Kotlyar et al. | 417/415 |

* cited by examiner

*Primary Examiner* — Michael Leslie

(74) *Attorney, Agent, or Firm* — Michael Best & Friedrich LLP

(57) ABSTRACT

Apparatus for drainage by well points, including a piston pump and a drive motor coupled to the piston pump by means of a transmission and provided with a drive shaft, which transmission is received in a housing and includes at least one crankshaft and a drive rod coupled thereto, the drive rod is coupled by means of a cross-head to a piston rod of the piston pump and the housing forms an oil sump and the transmission further includes an assembly of a worm and a worm wheel co-acting therewith and mounted on the crankshaft and the worm is provided on a worm shaft extending transversely relative to the crankshaft and vertically in operating mode of the apparatus for drainage by well points.

12 Claims, 8 Drawing Sheets

APPARATUS FOR DRAINAGE BY WELL POINTS

Figure 1:
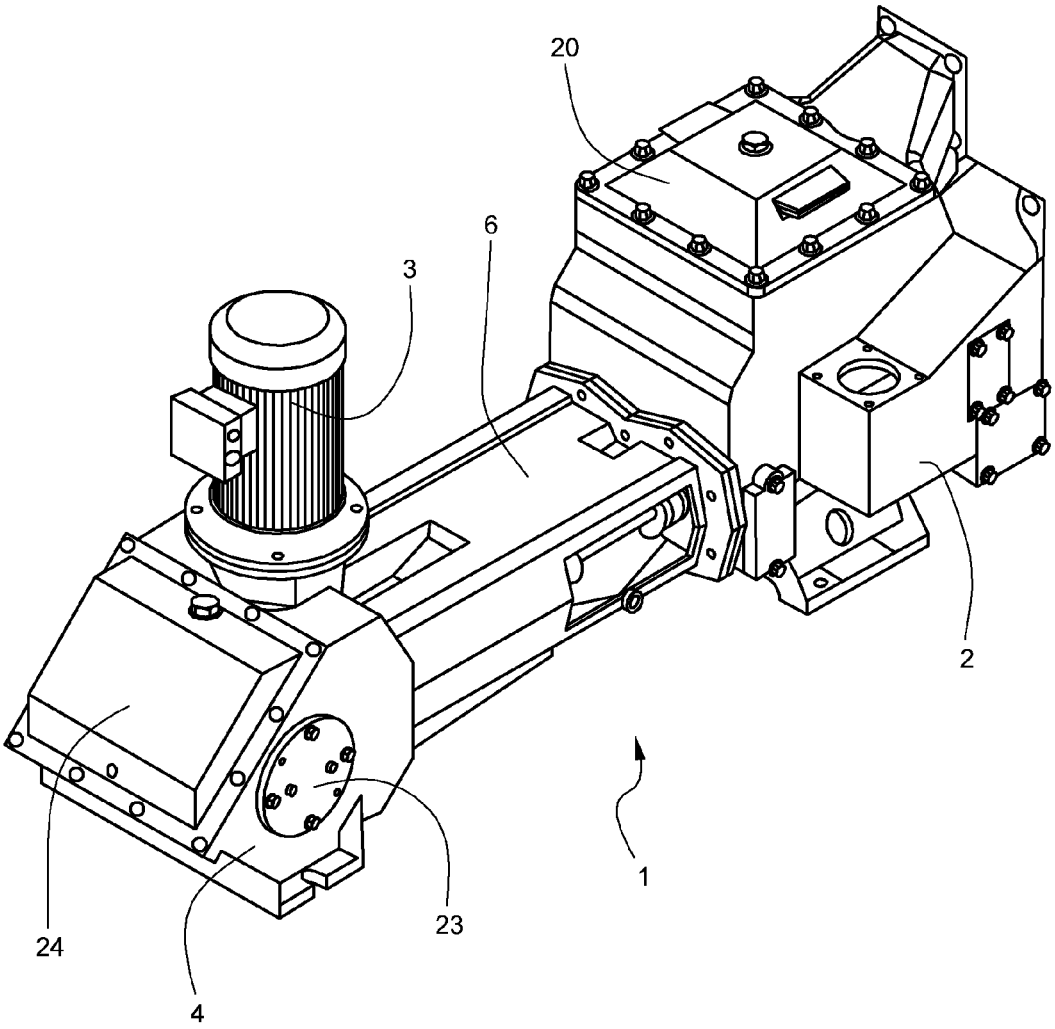

The invention relates to an apparatus for drainage by well points, comprising a piston pump and a drive motor coupled to the piston pump by means of a transmission and provided with a drive shaft, which transmission is received in a housing and comprises at least one crankshaft and a drive rod coupled thereto, which drive rod is coupled by means of a cross-head to a piston rod of the piston pump, wherein the housing forms an oil sump.

An apparatus for drainage by well points is known in numerous embodiments, wherein the crankshaft is mounted on the housing of a drive sump, from which the drive rod extends to the piston rod in a tunnel-like housing between the drive sump and the housing of the piston pump. The transmission between the drive shaft of the drive motor and the crankshaft is provided by a belt tensioned between a first pulley on the drive shaft and a second pulley on a second shaft mounted on the housing parallel to the crankshaft and the drive shaft, wherein in the case the drive motor is a combustion engine the second pulley is coupled to a flywheel.

The known apparatus for drainage by well points has a relatively large volume, this being perceived as a drawback by the user because the apparatus is usually intended for temporary use, for instance on a building site, and must therefore be transported frequently.

Even when the apparatus is wholly enclosed by a housing, the belt transmission in the known apparatus entails safety risks. The adjustment of a belt, i.e. tensioning thereof in the correct manner, requires the deployment of sufficiently qualified technical personnel, such personnel becoming increasingly less readily available.

Known from the U.S. Pat. No. 779,907 is an air pump which is coupled by means of a transmission to a drive motor provided with a drive shaft. The transmission is received in a housing and comprises a drive rod coupled to a plunger of the air pump and a crankshaft coupled thereto. The housing forms a drive sump and the crankshaft and the drive shaft extend in mutually perpendicular directions. The transmission comprises an assembly of a worm and a worm wheel co-acting therewith. The worm wheel is mounted on the crankshaft and in operating mode the worm shaft extends horizontally in line with the drive shaft. No mention is made of the lubrication of the coupling of the drive rod and the plunger. This lubrication evidently takes place by means of oil carried out of the drive sump by the worm wheel and dripping along the drive rod to the coupling.

The horizontal placing of the worm shaft, in line with the drive shaft, unambiguously determines the distance between the crankshaft and the drive shaft, and thereby the drive motor, and thereby represents a limitation to the possible options for the location of the drive motor relative to this crankshaft. The lubrication of the coupling by oil being carried by the worm wheel entails the risk of this lubrication being insufficient.

It is an object of the invention to provide an apparatus for drainage by well points which is compact and which is thereby easy to transport, low-noise and energy-efficient.

This apparatus has to be low-maintenance and has to be safe to operate, wherein it can suffice to deploy personnel having no specific technical knowledge or skills.

This apparatus further has to be provided with means for lubricating the cross-head in simple and effective manner.

These objects are realized, and other advantages gained, with an apparatus for drainage by well points of the type stated in the preamble, wherein according to the invention the transmission further comprises an assembly of a worm and a worm wheel co-acting therewith and mounted on the crankshaft, which worm is provided on a worm shaft extending transversely relative to the crankshaft and vertically in operating mode of the apparatus for drainage by well points.

Because the transmission is assembled from co-acting components of a stiff or non-stretchable material it has the inherent advantage that it can be permanently accommodated in a housing and requires no or at least hardly any maintenance.

A transmission, wherein according to the invention the worm shaft extends vertically in operating mode of the apparatus for drainage by well points, makes it possible to place the drive motor such that an exceptionally compact whole is obtained.

In an embodiment an apparatus for drainage by well points according to the invention is provided with at least one disc placed on the crankshaft and a scraper co-acting with this disc.

The disc provides the option of carrying oil upward from the sump and subsequently having the upward carried oil scraped off by the scraper and deposited on components of the transmission to be lubricated.

In another embodiment the scraper comprises a flat body extending downward from the upper side of the housing in radial direction of the disc and, in vertical projection, to a position above the coupling of the drive rod to the crankshaft.

In a subsequent embodiment the drive rod is provided with a channel for transporting oil from the oil sump to the cross-head.

The channel is for instance formed by an open gutter on the upper side of the drive rod and a conduit connected thereto by a bore, extending through the drive rod and debouching in the cross-head.

The rotation direction of the worm wheel is preferably chosen such that the path velocity of the part of the worm wheel co-acting with the worm is directed upward.

Such a rotation direction provides the advantage that the load on the upper bearing of the worm shaft is relatively low, which results in a longer lifespan of this bearing.

In an advantageous embodiment of an apparatus for drainage by well points according to the invention the piston pump is a piston pump of the double-action type provided with at least two pistons, and the transmission comprises a crankshaft and two drive rods on either side of the worm wheel coupled thereto, which drive rods are each coupled by means of a cross-head to one of two respective piston rods of the piston pump.

The drive motor is for instance placed on the housing for the transmission, wherein the drive shaft is directed in the line of the worm shaft.

In a subsequent embodiment, wherein the apparatus for drainage by well points further comprises a housing for the piston rod of a driven piston pump, the drive motor is placed above or on the housing for the piston rod and the drive shaft is directed parallel to the piston rod.

The drive motor can comprise any suitable type of motor, for instance an electric motor or a diesel motor.

The invention will be elucidated hereinbelow on the basis of exemplary embodiments, with reference to the drawings.

In the drawings

Figure 2:
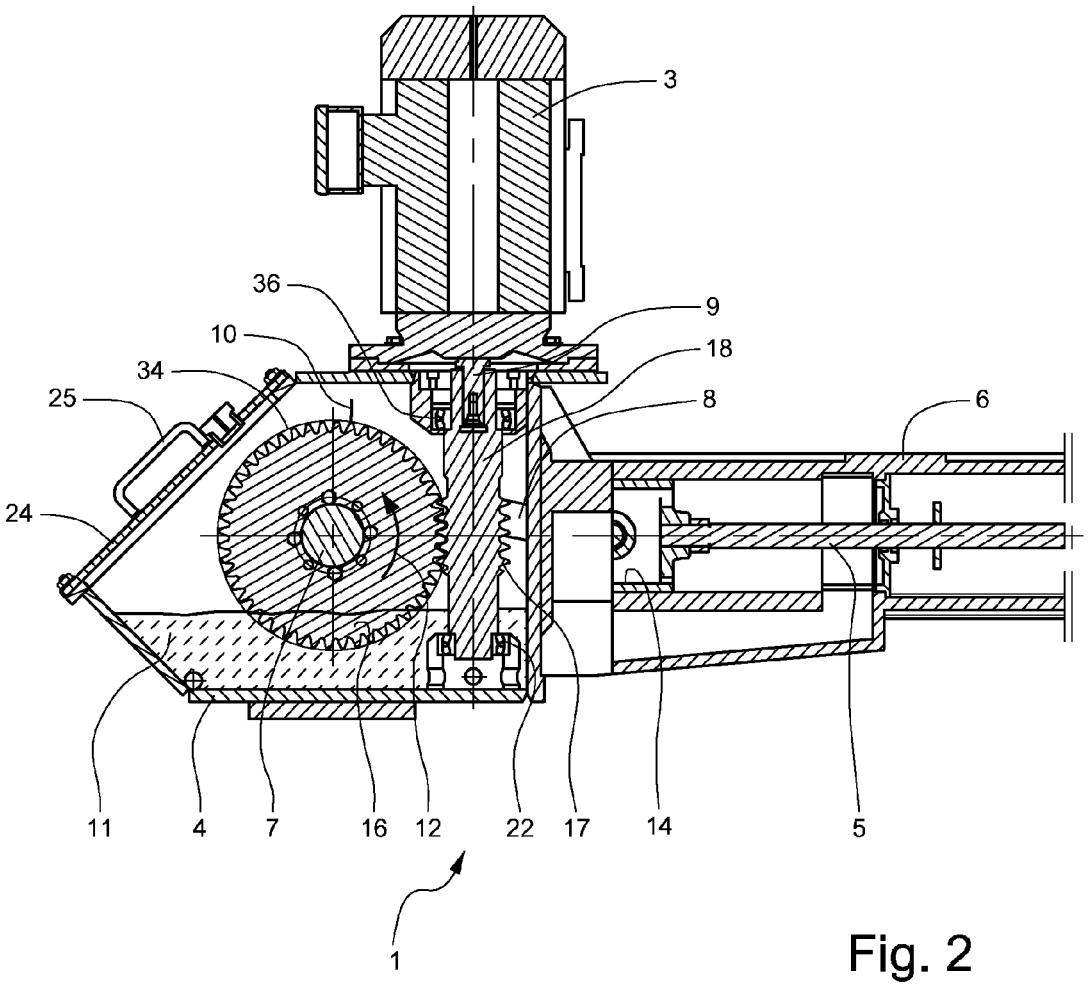
Figure 3A:
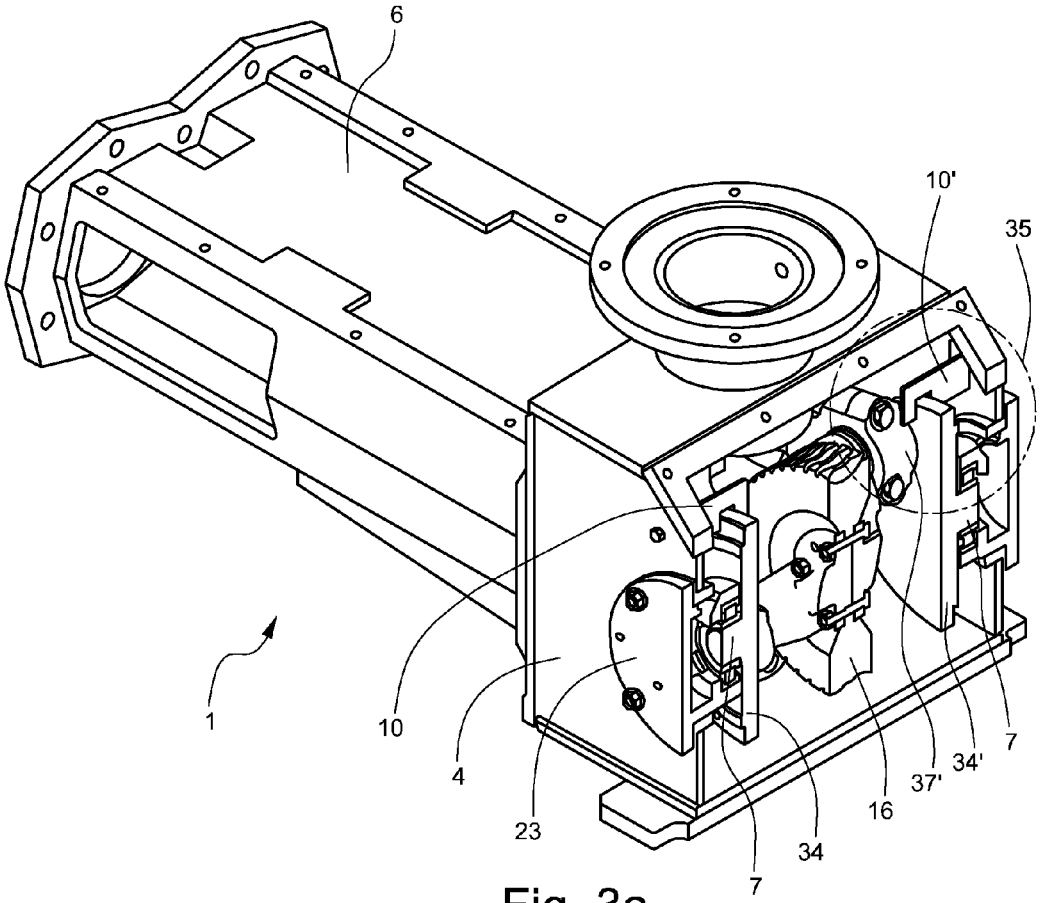
Figure 3B:
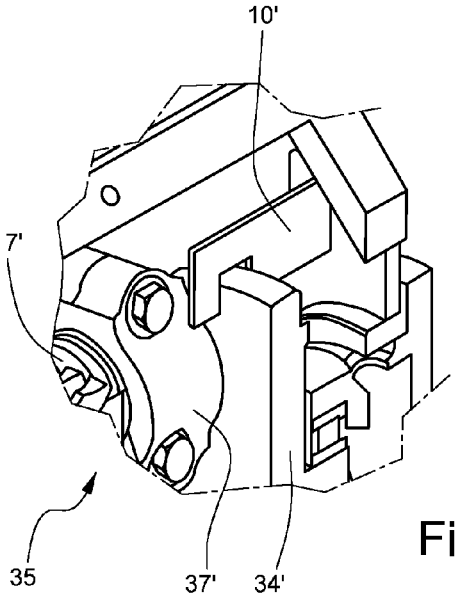
Figure 4B:
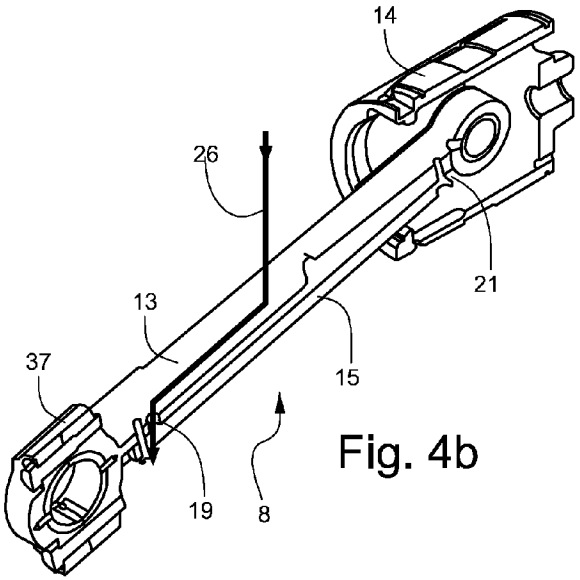
Figure 4D:
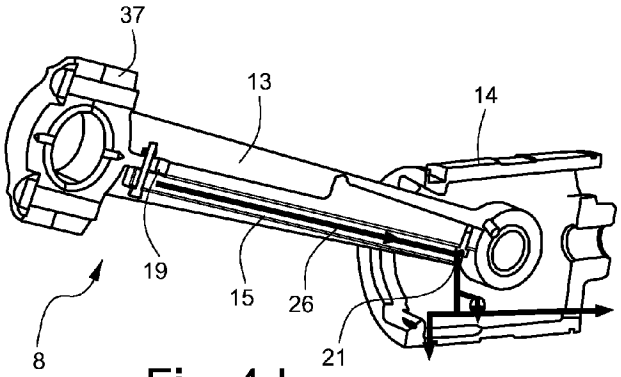
Figure 4A:
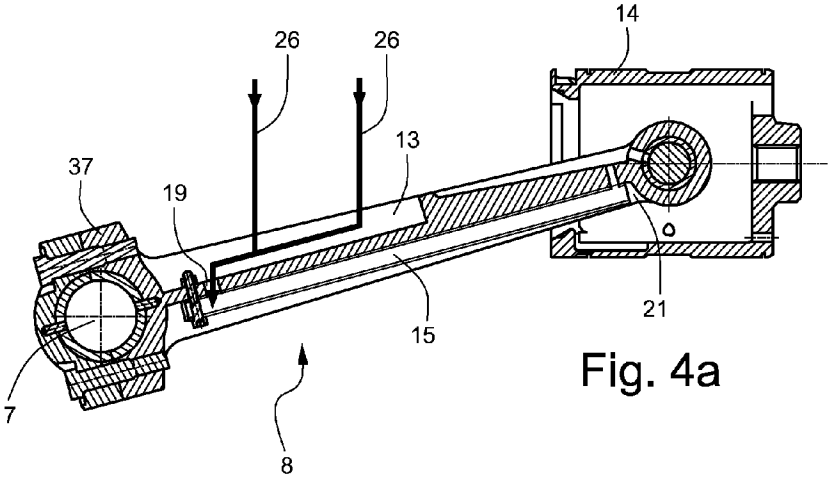
Figure 4C:
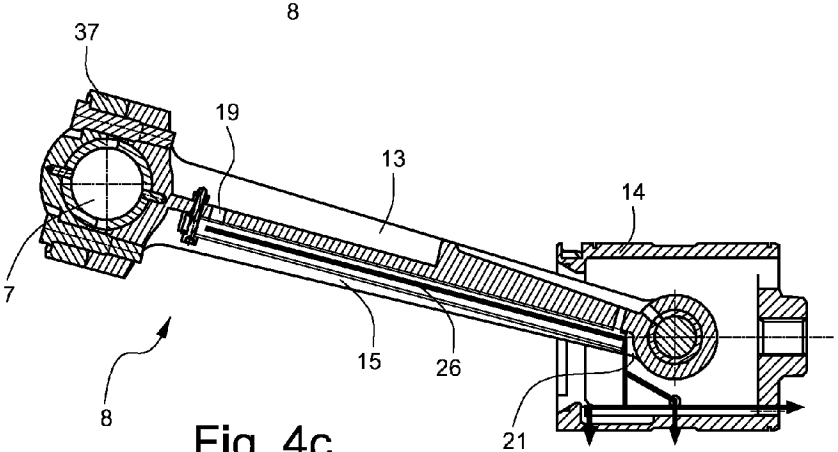
Figure 5:
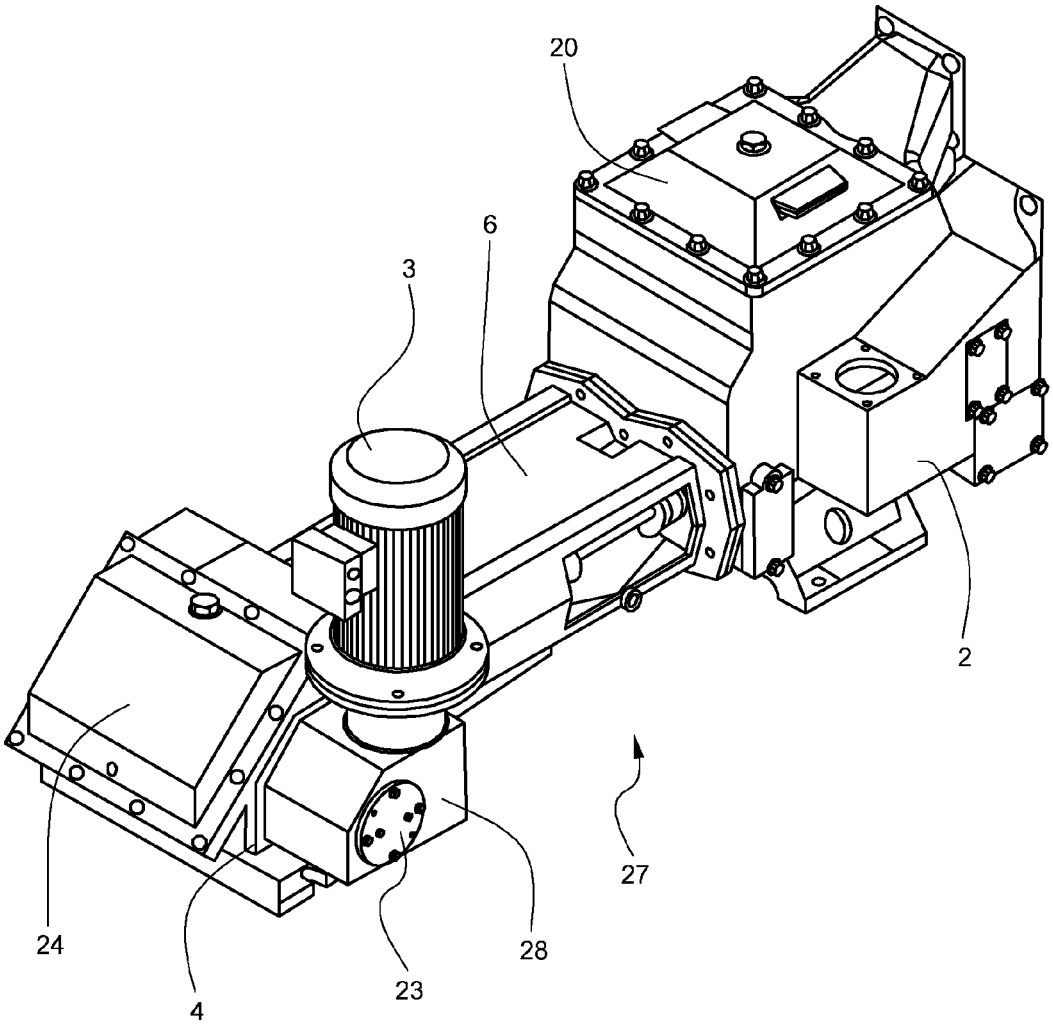
Figure 6:
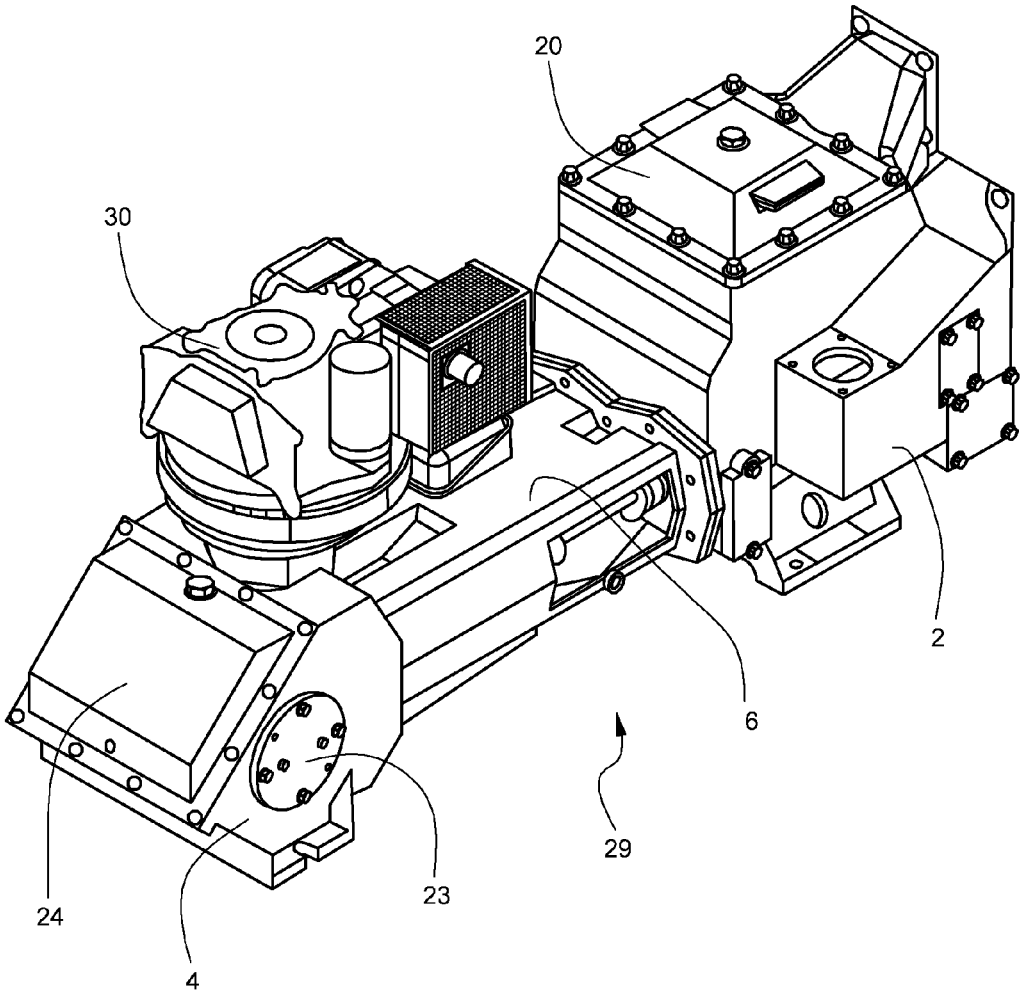
Figure 7:
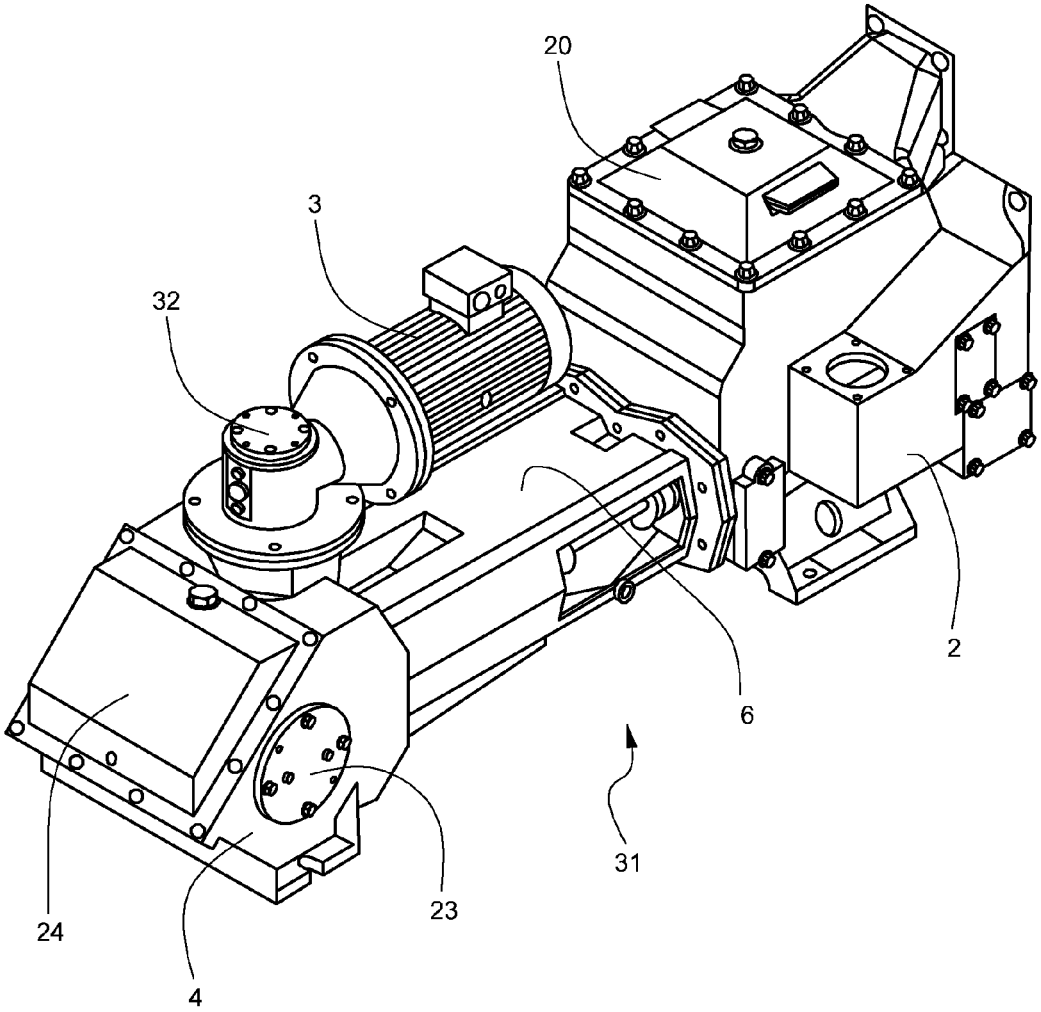
Figure 8:
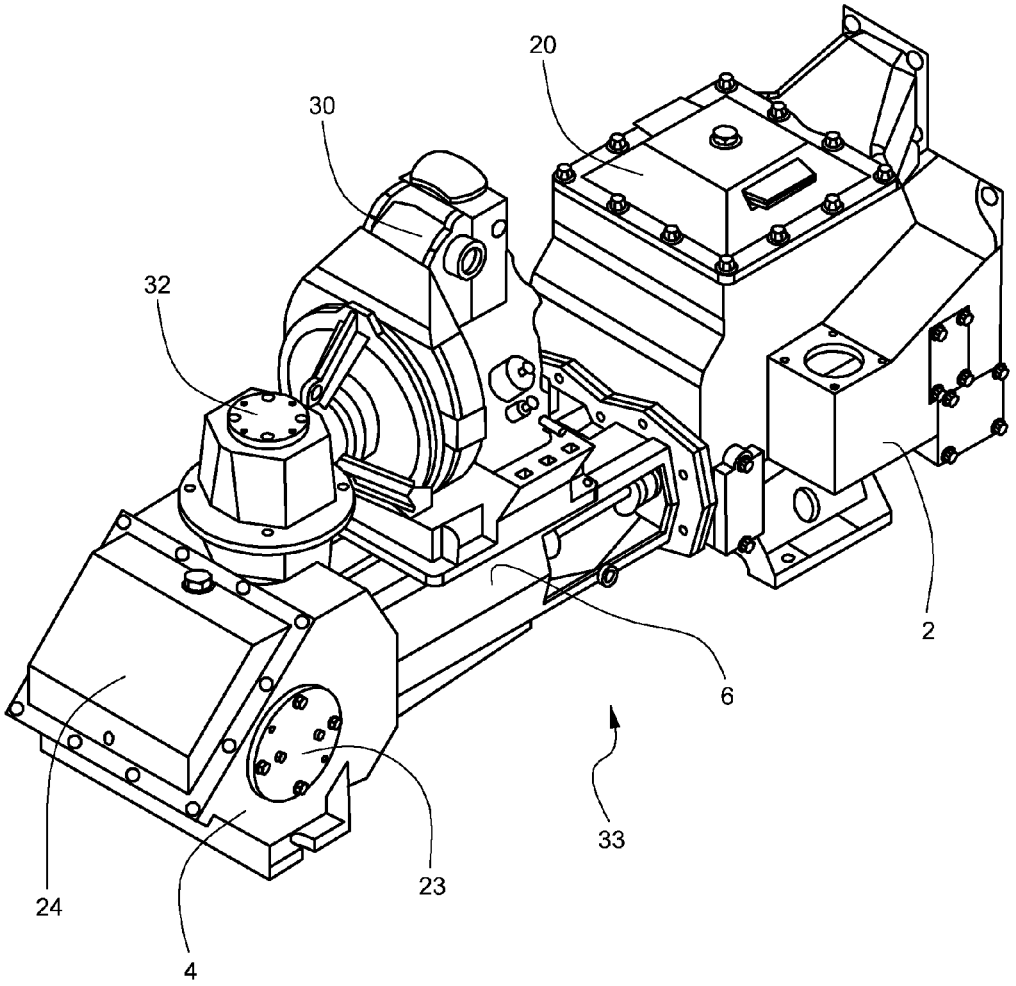

FIG. 1 is a perspective view of a first embodiment of an apparatus for drainage by well points according to the invention, FIG. 2 is a simplified projection of a part of the apparatus for drainage by well points shown in FIG. 1, FIG. 3*a* is a cut-away perspective view of a part of the apparatus for drainage by well points shown in FIG. 1, FIG. 3*b* is a cut-away perspective view of a detail of FIG. 3*a*, FIG. 4*a*-4*b* show in projection and cut-away perspective view a detail of the embodiment of FIG. 2 in a first position, and FIG. 4*c*-4*d* show in projection and cut-away perspective view a detail of the embodiment of FIG. 2 in a second position, FIG. 5 is a perspective view of a second embodiment of an apparatus for drainage by well points according to the invention, FIG. 6 is a perspective view of a third embodiment of an apparatus for drainage by well points according to the invention, FIG. 7 is a perspective view of a fourth embodiment of an apparatus for drainage by well points according to the invention, and FIG. 8 is a perspective view of a fifth embodiment of an apparatus for drainage by well points according to the invention.

Corresponding components are designated in the figures with the same reference numerals.

FIG. 1 shows an apparatus for drainage by well points 1 with a double-action piston pump 2, an electric motor 3, a transmission in a housing 4 and a housing 6 for the piston rods 5 (shown in FIG. 2). The figure also shows a cover 20 for piston pump 2, a cover 24 and a cover plate 23 covering respectively housing 4 and crankshaft 7 (shown in FIG. 2).

FIG. 2 shows housing 4 of the apparatus for drainage by well points 1 shown in FIG. 1 for the transmission from drive motor 3 to piston pump 2 (shown in FIG. 1), with a crankshaft 7 coupled by means of a drive rod 8 and a cross-head 14 to piston rod 5 of the piston pump. Mounted on crankshaft 7 is a worm wheel 16 which is driven by a worm 17 on a vertical worm shaft 18 mounted on housing 4 with bearings 36, 22. Mounted on crankshaft 7 are two discs (of which one, 34, is shown) which carry oil 11 out of the underside of housing 4 during rotation of the worm wheel in counterclockwise direction as according to arrow 12 and which each co-act with a scraper 10, using which oil carried by the respective disc 34 is scraped off. The scraped-off oil comes to lie in a channel 13 in the respective drive rod 8 (shown in FIG. 4*a*-4*d*) so as to lubricate the respective cross-head 14. The rotation direction 12 indicated in FIG. 2 is chosen such that the path velocity of the part of worm wheel 16 co-acting with worm 17 is directed upward, which results in a lower load, and thereby a longer lifespan of upper bearing 36. The figure also shows a handle 25 on cover 24 of housing 4.

As a result of the right-angled transmission by worm wheel 16 and worm 17, crankshaft 7 and worm shaft 18 extend in mutually perpendicular directions, which makes it possible in simple manner to place drive motor 3 on the housing 4 for the transmission, wherein drive shaft 9 of drive motor 3 is directed in the line of worm shaft 18.

FIG. 3*a* shows in the apparatus for drainage by well points 1 the housing 6 for piston rods 5 and a part of the interior of housing 4, with worm wheel 16 and on either side thereof the discs 34, 34' with respective scrapers 10, 10' which extend downward from the upper side of housing 4 in substantially radial direction of the respective discs 34, 34' and which extend in vertical projection to a position above the respective couplings 37' of the respective drive rods on crankshaft 7.

FIG. 3*b* shows in detail the part 35 circled in FIG. 3*a*.

FIGS. 4*a* and 4*b* show respectively in projection and in cut-away perspective view the drive rod 8 for the piston rod 5 shown in FIG. 2 in a first position, in which the end of drive rod 8 coupled to crankshaft 7 is in its lowest position and oil 11 (indicated by arrows 26) is guided out of sump 4 via an open gutter 13 on the upper side of drive rod 8 and a bore 19 to a conduit 15 received on the underside of drive rod 8, which conduit 15 has an outflow 21 at its end directed toward cross-head 14.

FIGS. 4*c* and 4*d* show respectively in projection and in cut-away perspective view the drive rod 8 for the piston rod 5 shown in FIG. 2 in a second position, in which the end of drive rod 8 coupled to crankshaft 7 is in its highest position and oil 11 (indicated by arrows 26) is guided from the conduit 15 debouching at cross-head 14 toward cross-head 14. The residue of the oil is fed back to housing 4.

FIG. 5 shows an apparatus for drainage by well points 27 with a piston pump 2, an electric motor 3, a transmission in a housing 4 and a housing 6 for a piston rod 5. Housing 4 is provided on one of its sides (on the right in the figure) with an extension 28 in which an elongated part of the crankshaft and the worm wheel are accommodated and on which an electric motor 3 is placed. This configuration enables a lower placing of electric motor 3 compared to the configuration shown in FIG. 1, wherein the overall width of housing 4 is however greater.

FIG. 6 shows an apparatus for drainage by well points 29 which differs from the apparatus for drainage by well points 1 shown in FIG. 1 in that it is provided with a diesel motor 30 instead of an electric motor 3 for the purpose of driving piston pump 2.

FIG. 7 shows an apparatus for drainage by well points 31 which differs from the apparatus for drainage by well points 1 shown in FIG. 1 in that the drive shaft (not shown) of electric motor 3 is coupled to the worm shaft (not shown) by means of a right-angled transmission 32 and electric motor 3 is placed above housing 6 for the piston rod, whereby an exceptionally compact whole is obtained.

FIG. 8 shows an apparatus for drainage by well points 33 which differs from the apparatus for drainage by well points 1 shown in FIG. 6 in that it is provided with a diesel motor 30 instead of an electric motor 3 for the purpose of driving piston pump 2, wherein diesel motor 30 is placed above and on housing 6 for the piston rod.

The invention claimed is:

1. An apparatus for drainage by well points comprising: a piston pump and a drive motor coupled to the piston pump by means of a transmission and provided with a drive shaft, the transmission being received in a housing and including at least one crankshaft and a drive rod coupled thereto, the drive rod being coupled by means of a cross-head to a piston rod of the piston pump, wherein the housing forms an oil sump and the transmission further includes an assembly having a worm and a worm wheel co-acting therewith and being mounted on the crankshaft, the worm being provided on a worm shaft extending transversely relative to the crankshaft and vertically in an operating mode of the apparatus for drainage by well points.

2. An apparatus for drainage by well points as claimed in claim 1, further comprising at least one disc placed on the crankshaft and a scraper co-acting with the disc.

3. An apparatus for drainage by well points as claimed in claim 2, wherein the scraper includes a flat body extending downward from an upper side of the housing in a radial direction of the disc and in vertical projection to a position above the coupling of the drive rod to the crankshaft.

4. An apparatus for drainage by well points as claimed in claim 1, wherein the drive rod is provided with a channel for transporting oil from the oil sump to the cross-head.

5. An apparatus for drainage by well points as claimed in claim 4, wherein the channel is formed by an open gutter on an upper side of the drive rod and a conduit connected thereto by a bore extending through the drive rod and debouching in the cross-head.

6. An apparatus for drainage by well points as claimed in claim 1, wherein a rotation direction of the worm wheel is chosen such that a path velocity of a part of the worm wheel co-acting with the worm is directed upward.

7. An apparatus for drainage by well points as claimed in claim 1, wherein the piston pump is a double-action type provided with at least two pistons, and the transmission includes one of the at least one crankshaft and two drive rods on either side of the worm wheel and coupled thereto, and the drive rods are each coupled by means of a cross-head to one of two piston rods of the piston pump.

8. An apparatus for drainage by well points as claimed in claim 1, wherein the drive motor is placed on the housing for the transmission, and the drive shaft is directed in the line of the worm shaft.

9. An apparatus for drainage by well points as claimed in claim 1, further comprising a housing for the piston rod of the piston pump, wherein the drive motor is placed above the housing for the piston rod and the drive shaft is directed parallel to the piston rod.

10. An apparatus for drainage by well points as claimed in claim 1, further comprising a housing for the piston rod of the piston pump, wherein the drive motor is placed on the housing for the piston rod and the drive shaft is directed parallel to the piston rod.

11. An apparatus for drainage by well points as claimed in claim 1, wherein the drive motor includes an electric motor.

12. An apparatus for drainage by well points as claimed in claim 1, wherein the drive motor includes a diesel motor.

* * * * *